US009169107B2

(12) United States Patent
Wilts et al.

(10) Patent No.: US 9,169,107 B2
(45) Date of Patent: Oct. 27, 2015

(54) METHOD AND MOUNTING SYSTEM FOR MOUNTING LIFT COMPONENTS

(71) Applicant: THYSSENKRUPP ELEVATOR AG, Essen (DE)

(72) Inventors: Hermann Wilts, Dietzenbach (DE); Martin Madera, Neuhausen (DE); Michael Neumeier, Esslingen (DE); Holger Zerelles, Leinfelden-Echterdingen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 0 days.

(21) Appl. No.: 14/407,154

(22) PCT Filed: Jun. 5, 2013

(86) PCT No.: PCT/EP2013/061561
§ 371 (c)(1),
(2) Date: Dec. 11, 2014

(87) PCT Pub. No.: WO2013/186096
PCT Pub. Date: Dec. 19, 2013

(65) Prior Publication Data

US 2015/0107186 A1 Apr. 23, 2015

(30) Foreign Application Priority Data

Jun. 11, 2012 (DE) ..... 10 2012 104 993

(51) Int. Cl.

| | |
|---|---|
| ***E04G 3/20*** | (2006.01) |
| ***B66B 19/00*** | (2006.01) |
| ***E04G 3/24*** | (2006.01) |
| ***E04G 3/28*** | (2006.01) |

(52) U.S. Cl.
CPC ..... *B66B 19/002* (2013.01); *E04G 3/246* (2013.01); *E04G 3/28* (2013.01); *E04G 2003/286* (2013.01)

(58) Field of Classification Search
CPC ..... B66B 19/00; B66B 19/002; E04G 3/246; E04G 3/28; E04G 2003/286; E04H 12/00; E04H 12/34
See application file for complete search history.

(56) References Cited

U.S. PATENT DOCUMENTS

| | | | | |
|---|---|---|---|---|
| 1,365,252 | A * | 1/1921 | Langill | 187/269 |
| 8,186,130 | B2 * | 5/2012 | Van Der Meijden et al. | 52/745.17 |

FOREIGN PATENT DOCUMENTS

| | | | |
|---|---|---|---|
| FR | 2782072 | A1 | 2/2000 |

OTHER PUBLICATIONS

German Language International Search Report for International patent application No. PCT/EP2013/061561; mailing date Aug. 28, 2013.
English Translation of International Search Report for International patent application No. PCT/EP2013/061561; mailing date Aug. 28, 2013.
English language translation of abstract for FR 2782072 (A1).

* cited by examiner

*Primary Examiner* — Patrick Maestri
(74) *Attorney, Agent, or Firm* — ThyssenKrupp North America, Inc.

(57) ABSTRACT

The present disclosure relates to a method for mounting lift components of a lift system in a vertical shaft of a building with the aid of a mounting system which can be moved in the shaft, wherein the lift system has at least one cage which can travel along guide rails in the shaft. In order to develop the method to achieve shorter fitting times and less dependency upon how advanced the construction of the building is, according to the invention a mounting system is positioned in the shaft, having a support platform and a mounting platform, which are disposed one above the other, and having a lifting and pulling device, the support platform and the mounting platform being alternately fixed in position in the shaft and the platform which is not fixed in position at any one time is displaced in the vertical direction by means of the lifting and pulling device relative to the platform fixed in position. In addition, the invention relates to a mounting system for carrying out the method.

16 Claims, 6 Drawing Sheets

METHOD AND MOUNTING SYSTEM FOR MOUNTING LIFT COMPONENTS

CROSS REFERENCE TO RELATED APPLICATIONS

This application is a U.S. National Stage Entry of International Patent Application Serial Number PCT/EP2013/061561, filed Jun. 5, 2013, which claims priority to German patent application no. 102012104993.9, filed Jun. 11, 2012.

FIELD

The invention relates to a method for mounting elevator components of an elevator system in a vertical shaft of a building with the aid of a mounting system which can be moved in the shaft, wherein the elevator system has at least one car which can travel along guide rails in the shaft.

The invention also relates to a mounting system for carrying out the method.

BACKGROUND

Elevator systems have a series of elevator components which are mounted in a vertical shaft of a building. Elevator systems have, for example, guide rails which are fixed to a wall of the shaft and along which at least one car can travel upward and downward in the vertical direction. In most cases, the elevator components are mounted by a plurality of mounting platforms initially being introduced into the shaft in a shaft section and being secured in the shaft. Elevator components, for example guide rails, are then mounted in a working region of the shaft, said working region being accessible from the mounting platforms, by means of the mounting platforms. The mounting platforms are then removed and again introduced into the shaft in a higher shaft section and secured. The elevator components are therefore mounted section by section with ever recurring expenditure on the installation and removal of the mounting platforms. Mounting can be carried out as early as while the building is still under construction. The expenditure on mounting increases as the conveying height increases. Significant set-up times for the mounting platforms are required for buildings with a high conveying height. This is associated with significant mounting costs for the elevator system.

It has also already been proposed to use a mounting basket for mounting elevator components in a shaft. The mounting basket is suspended from a retaining apparatus in the shaft and can be moved up and down by means of a cable drive mechanism in order to mount elevator components in the shaft. So-called "false cars" are also known, it being possible for said false cars to be suspended from a retaining apparatus which is secured in the shaft and to be moved up and down by means of a cable drive mechanism. In contrast to mounting baskets, false cars are guided on guide rails which are already mounted and usually also have a capturing apparatus. Both mounting baskets and false cars require a retaining apparatus for suspension purposes, said retaining apparatus being secured, for example, to a shaft ceiling which is already complete or to temporary supports or supporting points in the shaft. The use of temporary supports or supporting points as fixing points for the retaining apparatus allows mounting of elevator components as early as when the shaft is not yet complete. However, this requires a high degree of dependency on the progress of construction of the shaft and is likewise associated with considerable set-up times and mounting costs.

BRIEF DESCRIPTION OF THE DRAWINGS

The present disclosure is described in detail below with reference to the attached drawing figures, wherein.

DETAILED DESCRIPTION

Figure 1:
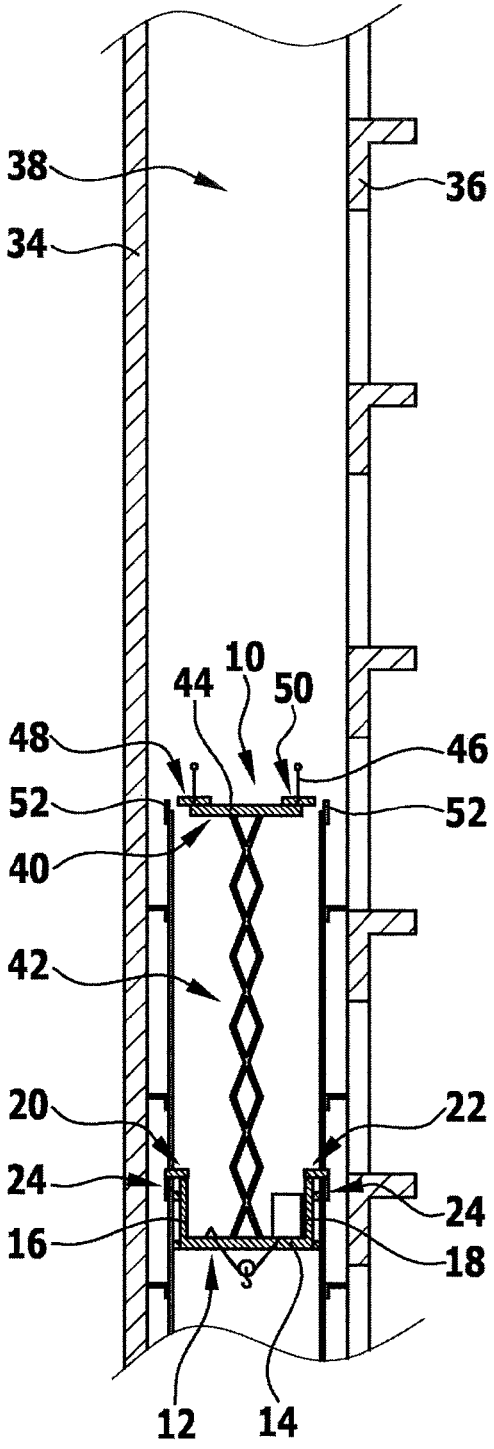
FIG. 1 is a schematic side profile view of a first embodiment of a mounting system of the present disclosure, wherein a support platform is supported on first connecting elements by means of which first guide rails are connected to second guide rails, and wherein a mounting platform assumes a position at the upper end of the second guide rails.

The object of the present invention is to provide a method for mounting elevator components of an elevator system, and also a mounting system for carrying out the method, said method having relatively short set-up times and a relatively low level of dependency on the progress of construction of the shaft.

According to the invention, this object is achieved with a method of the generic type in that a mounting system is positioned in the shaft, said mounting system having a support platform and a mounting platform which are arranged one above the other, and having a lifting and pulling device, wherein the support platform and the mounting platform are alternately fixed in position in the shaft, and the platform which is respectively not fixed in position is moved by means of the lifting and pulling device in the vertical direction relative to the platform which is fixed in position.

A mounting system which has a support platform and a mounting platform which are connected to one another by means of a lifting and pulling device is used in the method according to the invention. The vertical distance which the two platforms assume in relation to one another can be changed by means of the lifting and pulling device. Alternately, one of the two platforms is fixed in position in the shaft and the other platform is moved in the vertical direction in the shaft relative to the platform which is fixed in position. This allows the mounting system to move vertically upward and downward in the manner of a caterpillar in order to mount elevator components, for example guide rails or else electrical cabling or else sensors, in the shaft. The mounting platform forms a working platform which can be moved relative to the support platform in the shaft and from which elevator components can be mounted in the shaft. The elevator components are mounted largely independently of the progress of construction of the shaft. Mounting of the elevator components can be started as early as when the building is not yet complete. This allows elevator components to already be mounted in a lower region of the building, so that an elevator system can then be commissioned in this lower building region while construction measures are still being carried out in an upper building region.

The mounting system can move, for example, in such a way that, in a first step, the support platform is fixed in position in the shaft in a first position, and in that, in a second step, the mounting platform is raised by means of the lifting and pulling device in order to mount elevator components in the shaft, and in that, in a third step, the mounting platform is fixed in position in the shaft in a raised position, and in that, in a fourth step, the fixing of the support platform is removed, and the support platform is pulled vertically upward by means of the lifting and pulling device and is fixed in position again in a second position which is arranged above the first position.

In one advantageous embodiment of the method according to the invention, the support platform and/or the mounting platform are/is supported on the shaft wall, or on supporting elements which are secured to the shaft wall, in order to be fixed in position. Provision may be made, for example, for the support platform and/or the mounting platform to be fixed in position in recesses in or panels of the shaft wall or else to steel supports which are secured to the shaft wall.

It is advantageous when the support platform and/or the mounting platform are secured to the guide rails of the elevator system in order to be fixed in position. It is particularly advantageous when both the support platform and also the mounting platform are secured to the guide rails since this allows the entire mounting system to move along the guide rails in the manner of a caterpillar, wherein the support platform and the mounting platform are alternately secured to the guide rails and the platform which is not secured is moved along the guide rails by means of the lifting and pulling device.

In a particularly preferred refinement of the method according to the invention, the guide rails are connected to one another at the ends in pairs by means of connecting elements, and the support platform and/or the mounting platform are/is supported on the connecting elements in order to be fixed in position. In a refinement of the method of this kind, the connecting elements additionally perform the function of exerting supporting forces onto the support platform and/or the mounting platform, in addition to their function of connecting two guide rails, which are immediately adjacent to one another, to one another. The forces which are exerted by the support platform and/or mounting platform can be passed to the guide rails via the connecting elements, and to the shaft base via said guide rails. This has the advantage that the shaft walls are not subjected to excessively high loads when the support platform and the mounting platform are fixed in position.

It is expedient when, in a first step, the support platform is supported on first connecting elements, and, in a second step, the mounting platform is raised by means of the lifting and pulling device in order to mount elevator components, and, in a third step, is supported on second connecting elements which are arranged above the first connecting elements, and when, in a fourth step, the support platform is pulled vertically upward by means of the lifting and pulling device and is supported on the further connecting elements which are arranged above the first connecting elements.

It is expedient when the support platform is supported on the second connecting elements in the fourth step. Therefore, the mounting platform and the support platform are supported on the same connecting elements. This provides the option of constructing the mounting system in the pit at the beginning of mounting of the elevator system and then mounting first and second guide rails one above the other in the shaft by means of the vertically adjustable mounting platform, it being possible for said first and second guide rails to be connected to one another by means of first connecting elements. The mounting platform can then be supported on the first connecting elements and, thereafter, the support platform can be pulled vertically upward by means of the lifting and pulling device. The support platform can then likewise be supported on the first connecting elements. The mounting platform can then be raised by means of the lifting and pulling device, and third guide rails can be fitted onto the second guide rails, said third guide rails being connected to the second guide rails by means of second connecting elements. The mounting platform can then be supported on the second connecting elements, and the support platform can then be pulled along.

The support platform and the mounting platform are preferably provided with first coupling devices which are connected in a releasable manner to second coupling devices in order to support the support platform and the mounting platform on the connecting elements, said second coupling devices being secured to a connecting element in each case. This allows the mounting platform and the support platform to be supported on the connecting elements by means of the first and second coupling devices.

It is advantageous when the first coupling devices are brought into engagement with the second coupling devices. To this end, cutouts can be provided, for example, in the second coupling devices, it being possible for the first coupling devices to engage in said cutouts.

In one advantageous embodiment of the method according to the invention, the second coupling devices are fitted on a connecting element in each case and connected in a releasable manner to a guide rail. Therefore, vertical forces which occur can be transmitted directly to a connecting element by means of the first and second coupling devices, it being possible for the forces to be transmitted to guide rails from said connecting element. In order to avoid the second coupling devices being unintentionally detached from the connecting elements, the second coupling devices can additionally be connected in a releasable manner to the guide rails. By way of example, provision can be made for the second coupling devices to be clamped to the guide rails.

As already mentioned, guide rails in particular can be mounted in a shaft of a building by means of the method according to the invention. In the first step, the support platform is preferably supported on first connecting elements by means of which first and second guide rails are connected to one another, and, in the second step, a respective third guide rail is fitted on the upper ends of the second guide rails by means of the mounting platform and is connected to a second guide rail by means of a second connecting element, and, in the third step, the mounting platform is supported on the second connecting elements. Then, in the fourth step, the support platform is raised in the direction of the mounting platform by means of the lifting and pulling device and is likewise supported on the second connecting elements. Therefore, starting from the pit, the guide rails can be placed one on top of the other, connected to one another by means of the connecting elements and additionally fixed to the wall of the shaft, and the support platform and also the mounting platform can be supported on the connecting elements, wherein the mounting system moves in the shaft in the manner of a caterpillar.

The alternate fixing of the support platform and the mounting platform in the shaft not only allows the support platform and the mounting platform to move vertically upward starting from the pit, but movement of the support platform and the mounting platform vertically downward is also possible. This allows elevator components and also assembly personnel to be transported vertically upward and also vertically downward. To this end, the mounting platform can be fixed in position in the shaft, and the support platform can then be lowered vertically downward by means of the lifting and pulling device and then likewise be fixed in position in the shaft. In a subsequent method step, the fixing of the mounting platform can then be removed, and the mounting platform can be lowered downward by means of the lifting and pulling device. The mounting platform can then be fixed again and following this the support platform can be lowered further.

In one advantageous embodiment of the method, a lifting apparatus is secured to the support platform in order to raise elevator components. With a configuration of this kind, the support platform not only performs the function of supporting the lifting and pulling device and the mounting platform, but also additionally performs the function of raising further elevator components. To this end, a lifting apparatus is secured to the support platform.

By way of example, provision may be made for a cable winch to be secured to the support platform, it being possible for elevator components which are located beneath the support platform to be raised with the aid of said cable winch.

In order to simplify mounting of elevator components, it is advantageous when a lifting apparatus is secured to the mounting platform in order to raise elevator components.

The mounting platform is preferably in the form of a working platform for assembly personnel.

It is advantageous when the mounting platform has a lifting apparatus which makes it easier for the assembly personnel to raise elevator components.

It is expedient when a lifting crane is secured to the mounting platform, it being possible for elevator components to be raised with the aid of said mounting platform. In particular, a lifting crane which is arranged on the mounting platform makes it easier to raise guide rails which are secured to the wall of the shaft by means of the mounting platform.

As mentioned in the introductory part, the invention also relates to a mounting system for carrying out the method. The mounting system has a support platform and a mounting platform which are arranged one above the other, and also has a lifting and pulling device with the aid of which the vertical distance between the support platform and the mounting platform can be varied. The support platform and the mounting platform can alternately be fixed in position in the shaft, and the platform which is respectively not fixed in position can be moved by means of the lifting and pulling device in the vertical direction relative to the platform which is fixed in position.

A mounting system of this kind has the advantage that elevator components can be mounted in a shaft of a building even before the building is complete. The two platforms can be moved in the shaft in the manner of a caterpillar by means of the lifting and pulling device. The mounting platform can form a working platform from which the elevator components, in particular guide rails, can be mounted in the shaft.

In one advantageous embodiment of the mounting system according to the invention, the support platform and/or the mounting platform can be supported on the shaft wall or on supporting elements which are secured to the shaft wall. By way of example, provision can be made for the support platform and/or the mounting platform to be supported in recesses in or panels of the shaft wall. As an alternative or in addition, provision can be made for the support platform and/or the mounting platform to be supported on steel supports which are secured to the shaft wall.

In one particularly preferred embodiment of the mounting system according to the invention, the support platform and/or the mounting platform can be secured to the guide rails of the elevator system. This has the advantage that the shaft walls are subjected only to low-level forces during a movement of the mounting system, and instead forces which occur are passed from the mounting system, via the guide rails, to the pit.

As already mentioned, the guide rails can advantageously be connected to one another at the ends in pairs by means of connecting elements. It is expedient when the support platform and/or the mounting platform are/is supported on the connecting elements.

First coupling devices are preferably arranged on the support platform and on the mounting platform, it being possible for said first coupling devices to be connected in a releasable manner to second coupling devices, wherein the second coupling devices can be secured to connecting elements by means of which two guide rails of the elevator system can be connected to one another at the ends.

It is expedient when the first and second coupling devices can be brought into engagement with one another. By way of example, provision can be made for the second coupling devices to have recesses into which coupling elements of the first coupling devices, for example movable extension arms, can be introduced.

As already mentioned, it is particularly advantageous when a first coupling device of the mounting platform and a first coupling device of the support platform can be connected in a releasable manner to a second coupling device at the same time, since this allows the mounting platform and the support platform to be supported on a connecting element by means of the same second coupling device when the mounting platform and the support platform assume a small vertical distance in relation to one another.

In one advantageous embodiment of the mounting system according to the invention, the second coupling devices can in each case be fitted on a connecting element by means of which two guide rails can be connected to one another at the ends.

The connecting elements can preferably be connected to the guide rails of the elevator system in an interlocking manner. By way of example, provision can be made for the connecting elements to be designed in a U-shaped manner in each case and to engage around the mutually facing end regions of two adjacent guide rails.

The first coupling devices in each case expediently comprise two extension arms which are held such that they can be moved on the support platform or on the mounting platform, so that said extension arms can be moved to and fro between an inoperative position and an operative position. In the inoperative position, the extension arms can be at a horizontal distance from guide rails which are already mounted in the shaft of the building, and in the operative position, the extension arms can project outward to such an extent that they can be connected to a second coupling device which is secured to a connecting element by means of which two guide rails are connected to one another at the ends.

It is advantageous when the support platform comprises a supporting plate and also two pillars which project vertically upward from the supporting plate and which each have a first coupling device. The lifting and pulling device can be secured to the supporting plate, said lifting and pulling device having the mounting platform at its upper end which is averted from the supporting plate. If the support platform is raised in the direction of the mounting platform, the pillars which project upward from the supporting plate allow the first coupling devices of the support platform, which first coupling devices are preferably arranged at the free ends of the pillars, to be connected to the second coupling devices which are already connected to the first coupling devices of the mounting platform. The length of the pillars can therefore correspond substantially to the vertical minimum distance which the support platform and the mounting platform may assume in relation to one another by means of the lifting and pulling device.

It is particularly advantageous when the guide elements which can be applied to the guide rails of the elevator system are arranged on the pillars. By way of example, provision can be made for the guide elements to be designed as guide shoes which can be brought into engagement with the guide rails. The support platform can be guided on the guide rails in the vertical direction by means of the guide elements, while guiding of the mounting platform on the guide rails can be dispensed with.

In one advantageous embodiment, the mounting platform has a mounting plate on which first coupling devices with coupling elements which can be moved to and fro between an inoperative position and an operative position are held. By way of example, the coupling elements can be held on the mounting platform such that they can be moved in the horizontal direction.

It is advantageous when the mounting platform is held on the support platform in a self-supporting manner by means of the lifting and pulling device. As a result, the additional guide elements for the mounting platform can be dispensed with. In a refinement of this kind of the mounting system according to the invention, the lifting and pulling device serves not only to move the mounting platform downward and upward in the vertical direction relative to the support platform, but rather also serves to guide the mounting platform in the vertical direction, wherein the mounting platform, like the lifting and pulling device, is likewise supported by the support platform.

In one advantageous refinement of the mounting system according to the invention, the lifting and pulling device comprises a scissors-type lifting table. Scissors-type lifting tables of this kind are known per se to a person skilled in the art. Said scissors-type lifting tables can have a high supporting force with a relatively low inherent weight. If the support platform is supported on first connecting elements, the mounting platform can be raised by means of the scissors-type lifting table to such an extent that it can then be supported on second connecting elements. This then allows the support platform to be raised by means of the scissors-type lifting table to such an extent that it can likewise be supported on the connecting elements which already serve to support the mounting platform.

In a preferred embodiment of the mounting system according to the invention, the lifting and pulling device has a cable winch. This provides the option of reducing the vertical distance between the support platform and the mounting platform by means of the cable winch and a traction cable. Furthermore, loads can be raised by means of the cable winch.

The following description of various embodiments of the present disclosure serves to provide further explanation in connection with the drawing figures.

Figure 2:
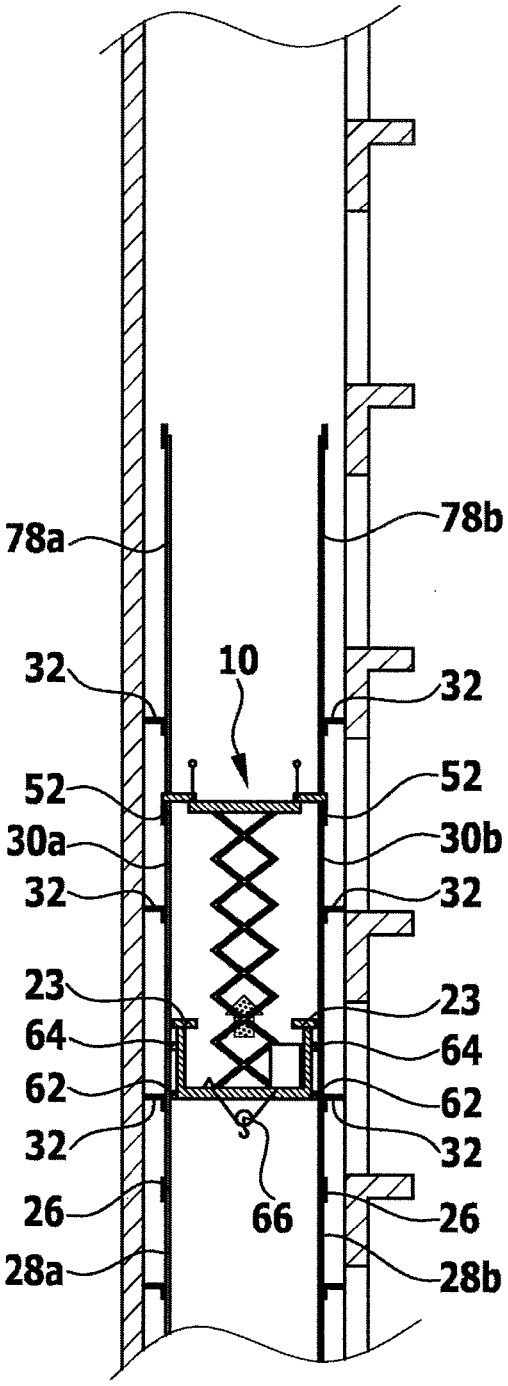
FIG. 2 is a schematic side profile view of the mounting system of FIG. 1, wherein the mounting platform is supported on second connecting elements which are arranged at the upper end of the second guide rails, and wherein the support platform is raised in the direction of the mounting platform.
Figure 3:
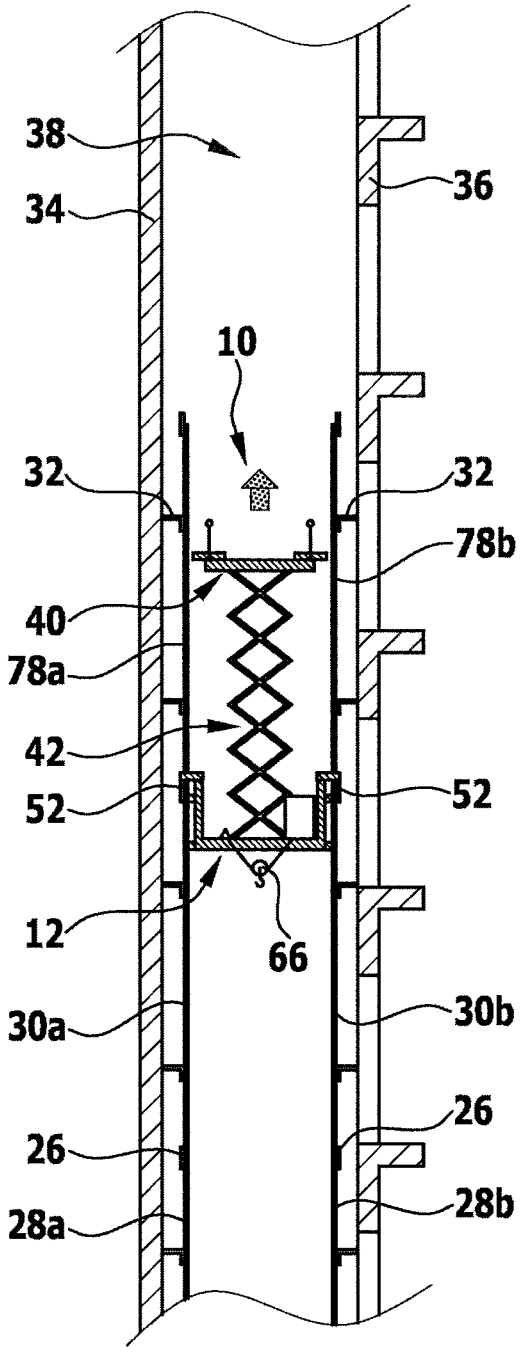
FIG. 3 is a schematic side profile view of the mounting system of FIG. 1, wherein the support platform is supported on the two connecting elements and the mounting platform is raised in order to mount third guide rails.
Figure 4:
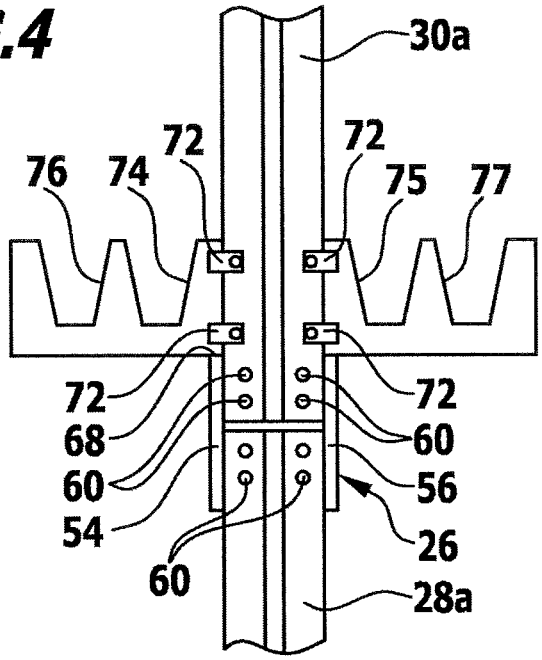
FIG. 4 is a schematic front view of an embodiment of the mutually facing end regions of two guide rails which are connected to one another by means of a connecting element, wherein a second coupling device is fitted on the connecting element.

FIGS. 1 to 5 schematically show a first embodiment of a mounting system according to the invention which is denoted by reference symbol 10 overall. The mounting system 10 comprises a support platform 12 with a supporting plate 14 from which two pillars 16, 18 project vertically upward. The pillars 16, 18 each have, at their upper end, a first coupling device 20 and, respectively, 22 with extension arms 23 which, in FIG. 1, assume an operative position in which they project outward in the horizontal direction and are each connected to a second coupling device 24 which is illustrated in FIG. 4. The first coupling devices 20 and 22 are each supported on a first connecting element 26 by means of the second coupling devices 24, a first guide rail 28*a* and, respectively, 28*b* being connected to a second guide rail 30*a* and, respectively, 30*b* by means of said connecting element 26. The guide rails 28*a*, 28*b* are fixed to the shaft walls 34, 36 of a shaft 38 with the aid of the retaining elements 32.

In addition to the support platform 12, the mounting system 10 has a mounting platform 40 which is held in a self-supporting manner on the supporting plate 14 of the support platform 12 by means of a lifting and pulling device in the form of a scissors-type lifting table 42. The mounting platform 40 can be moved relative to the support platform 12 in the vertical direction with the aid of the scissors-type lifting table 42.

The mounting platform 40 has a mounting plate 44 which has a handrail 46 and forms a working platform for assembly personnel. Further first coupling devices 48, 50 with extension arms 23 which can be moved between an inoperative position and an operative position in the horizontal direction are held on the mounting plate 44. The first coupling devices 48, 50 of the mounting platform 40 are of identical design to the first coupling devices 20 and 22 of the support platform 12.

In FIG. 1, the support platform 12 assumes a position at the upper end of the first guide rails 28*a*, 28*b*, wherein said support platform is supported on the first connecting elements 26 in the vertical direction by means of the first coupling devices 20, 22 and the second coupling devices 24. In FIG. 1, the mounting platform 40 assumes a position at the upper end of the second guide rails 30*a*, 30*b*, and therefore assembly personnel who are standing on the mounting plate 44 of the mounting platform 40 can secure second connecting elements 52 to the upper end of the second guide rails 30*a*, 30*b*, said second connecting elements being of identical design to the first connecting elements 26.

Figure 5:
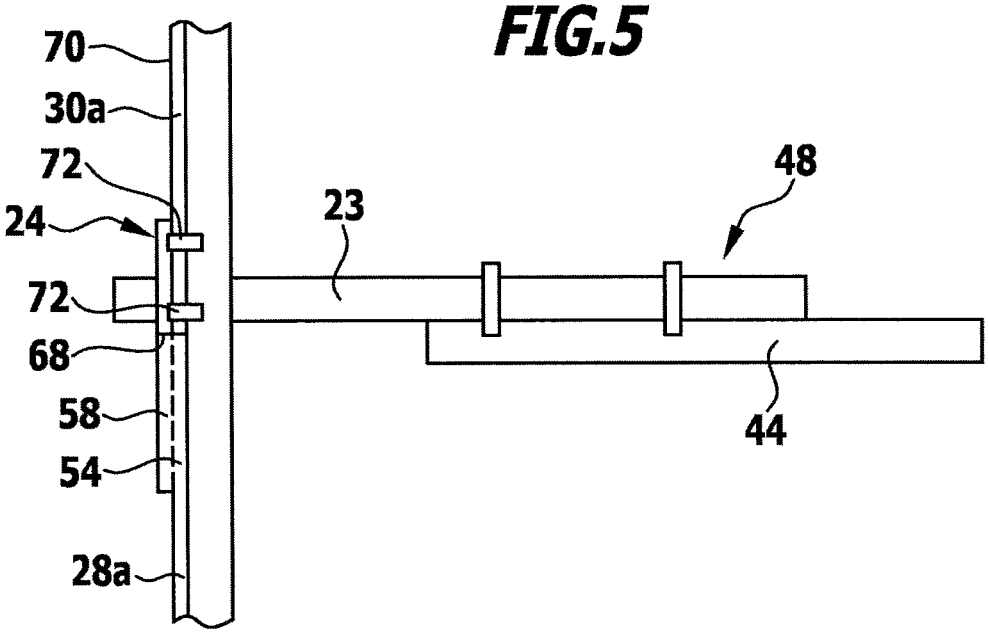
FIG. 5 is a schematic side view of an embodiment of the end region of the two guide rails from FIG. 4, wherein the second coupling device is connected to a first coupling device which is arranged on the mounting platform.

As is clear from FIGS. 4 and 5, the first connecting elements 26, like the second connecting elements 52, are likewise of U-shaped design in the illustrated exemplary embodiment and comprise two limbs 54, 56 which are integrally connected to one another by means of a web 58. The first connecting elements 26 engage around the mutually facing end regions of two guide rails 28*a* and 30*a* and, respectively, 28*b* and 30*b*, wherein said second guide rails can be connected to the guide rails 28*a*, 30*a*, and respectively, 28*b*, 30*b* with the aid of connecting screws 60, and with their respective web 54, 56 bear against the rear faces 70 of the guide rails 28*a*, 28*b*, 30*a*, 30*b* which face the shaft walls 34 and, respectively, 36. However, a U-shape is not absolutely necessary for the connecting elements 26, 52, but rather the connecting elements 26, 52 can also have a different shape, as is known to a person skilled in the art, for example the connecting elements can also be of T-shaped or flat design.

The pillars 16 and 18 each have two guide elements in the form of guide shoes 62, 64 which are arranged vertically at a distance from one another and can each be brought into contact with the guide rails. Guide shoes of this kind are known per se to a person skilled in the art.

The supporting plate 14 of the support platform 12 has, on its bottom face, a lifting apparatus in the form of a cable winch 66 with the aid of which elevator components can be raised and lowered. To this end, assembly personnel can assume a position on the supporting plate 14.

As is clear from FIG. 4, the two coupling devices 24 are of plate-like design and can be fitted on the upwardly pointing end faces 68 of the connecting elements 26 and, respectively, 52, wherein they bear flat against the rear face 70 of a guide rail and can be clamped to a guide rail with the aid of clamping elements 72. The second coupling devices 24 have, at the top, in each case two inner recesses 74, 75 and two recesses 76, 77 which are of identical design in the form of a trapezium. An inner recess 74 and, respectively, 75 and an outer recess 76 and, respectively, 77 are arranged on both sides of a guide rail.

The first coupling devices 20, 22 of the support platform 12, like the first coupling devices 48, 50 of the mounting platform 40, likewise each have two extension arms 23 which are of identical design, are trapezoidal in cross section and, in the extended operative position, engage in an interlocking manner in recesses in the second coupling devices 24. FIG. 5 shows an extension arm 23 of a first coupling device 48 of the mounting platform 40 in its extended position. In their operative position, the extension arms 23 of the first coupling devices 48, 50 of the mounting platform 40 enter the two inner recesses 74, 75 in the second coupling device 24. The extension arms 23 of the first coupling devices 20, 22 of the support platform 12 are at a relatively large distance from one another and, in their operative position, engage in the two outer recesses 76, 77 in the second coupling device 24.

After mounting of the second connecting elements 52 at the upper end of the second guide rails 30*a* and 30*b* is complete, assembly personnel who assume a position on the mounting plate 44 of the mounting platform 40 can fit third guide rails 78*a*, 78*b* on the second guide rails 30, 30*b*, secure said third guide rails to the shaft walls 34, 36 with the aid of retaining elements 32 and connect said third guide rails to the second guide rails 30*a*, 30*b* by means of the second connecting elements 52. The extension arms 23 of the first coupling devices 48, 50 of the mounting platform 40 can then be extended into their operative position in which the extension arms 23, as explained above, engage in the inner recesses 74, 75 of the second coupling devices 24. Therefore, the mounting platform 40 can be supported on the second guide rails 30*a*, 30*b* by means of the first coupling devices 48, 50 and the associated second coupling devices 24 and the second connecting elements 52.

Since the mounting system 10 is now vertically supported by means of the mounting platform 40 and the second connecting elements 52, the extension arms 23 of the first coupling devices 20, 22 of the support platform 12 can be moved from the first connecting elements 26 into their retracted inoperative position, and the support platform 12 can be raised in the direction of the mounting platform 40 with the aid of the scissors-type lifting table 52 to such an extent that the first coupling devices 20, 22 of the support platform 12 reach the second coupling devices 24 which are arranged on the second connecting elements 52. The extension arms 23 of the first coupling devices 20, 22 of the support platform 12 can then be extended into their operative position in which they enter the outer recesses 76, 77 in the second coupling devices 24.

FIG. 2 shows the mounting system 10 as the support platform 12 moves from a position at the upper end of the first guide rails 28*a*, 28*b* to the upper end of the second guide rails 30*a*, 30*b*.

After the first coupling devices 20, 22 are connected to the second coupling devices 24 which are positioned on the second connecting elements 52, the extension arms 23 of the first coupling devices 48, 50 of the mounting platform 40 are moved into their inoperative position, and the mounting platform 40 can be raised again by means of the scissors-type lifting table 42. This is shown in FIG. 3. In a subsequent mounting step, further guide rails can be fitted on the third guide rails 78*a*, 78*b* by means of the mounting platform 40, it being possible for said further guide rails to be fastened to the shaft walls 34, 36 with the aid of retaining elements and connected to the third guide rails 78*a*, 78*b* by means of further connecting elements. The mounting method can then be repeated by the mounting platform 40 being supported on the last mounted connecting elements and the support platform 12 being raised by the scissors-type lifting table 42.

The mounting system 10 therefore allows the support platform 12 and the mounting platform 40 to move in a caterpillar-like manner, wherein both platforms are supported on guide rails which can be mounted in the shaft 38 with the aid of the mounting system 10. It is not necessary for the support platform 12 and the mounting platform 40 to be supported on the building.

Figure 6:
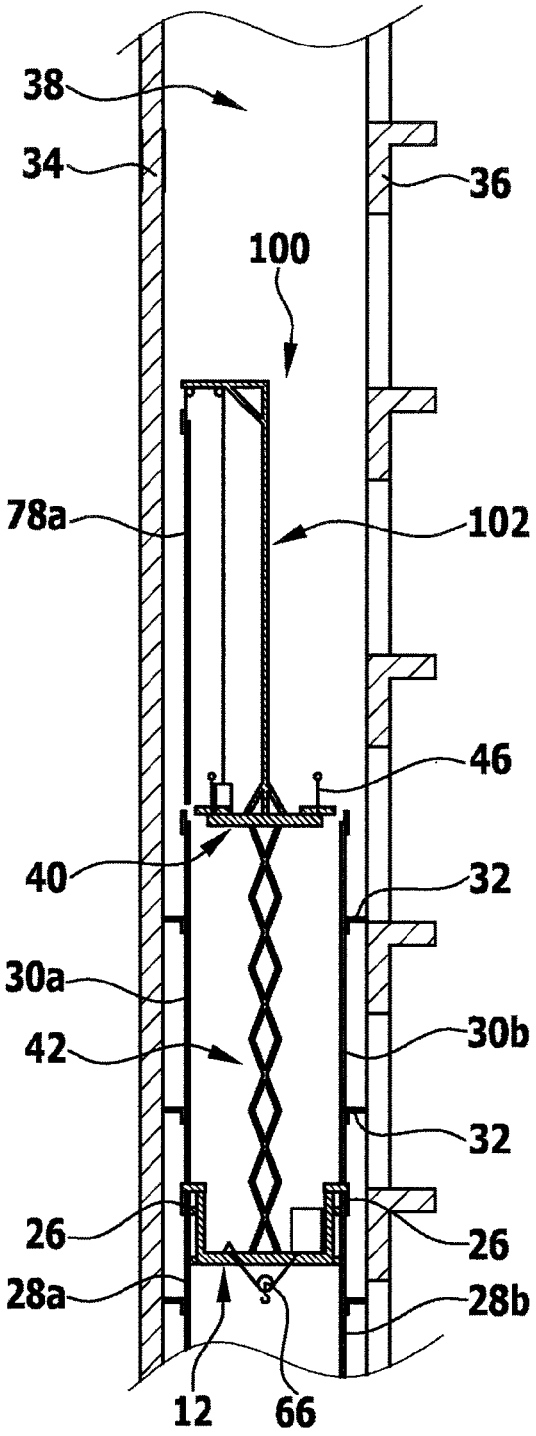
FIG. 6 is a schematic side profile view of an alternate embodiment of a mounting system of the present disclosure, wherein a support platform is supported on first connecting elements by means of which first guide rails are connected to second guide rails, and wherein a mounting platform assumes a position at the upper end of the second guide rails.
Figure 7:
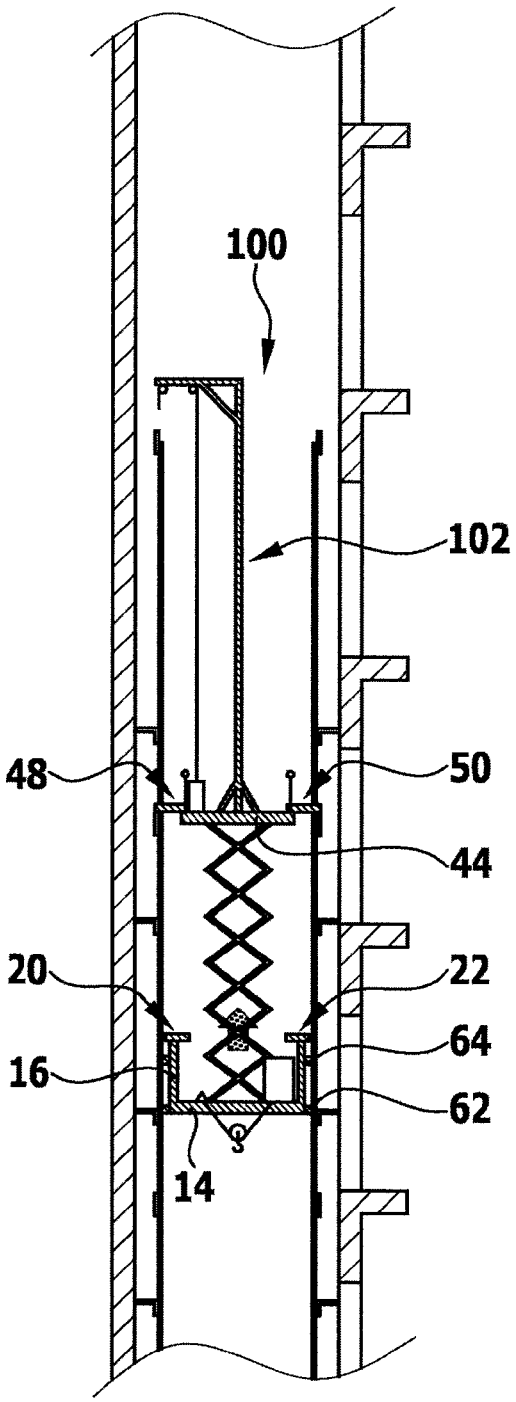
FIG. 7 is a schematic side profile view of the mounting system of FIG. 6, wherein the mounting platform is supported on second connecting elements which are arranged at the upper end of the second guide rails, and wherein the support platform is raised in the direction of the mounting platform.
Figure 8:
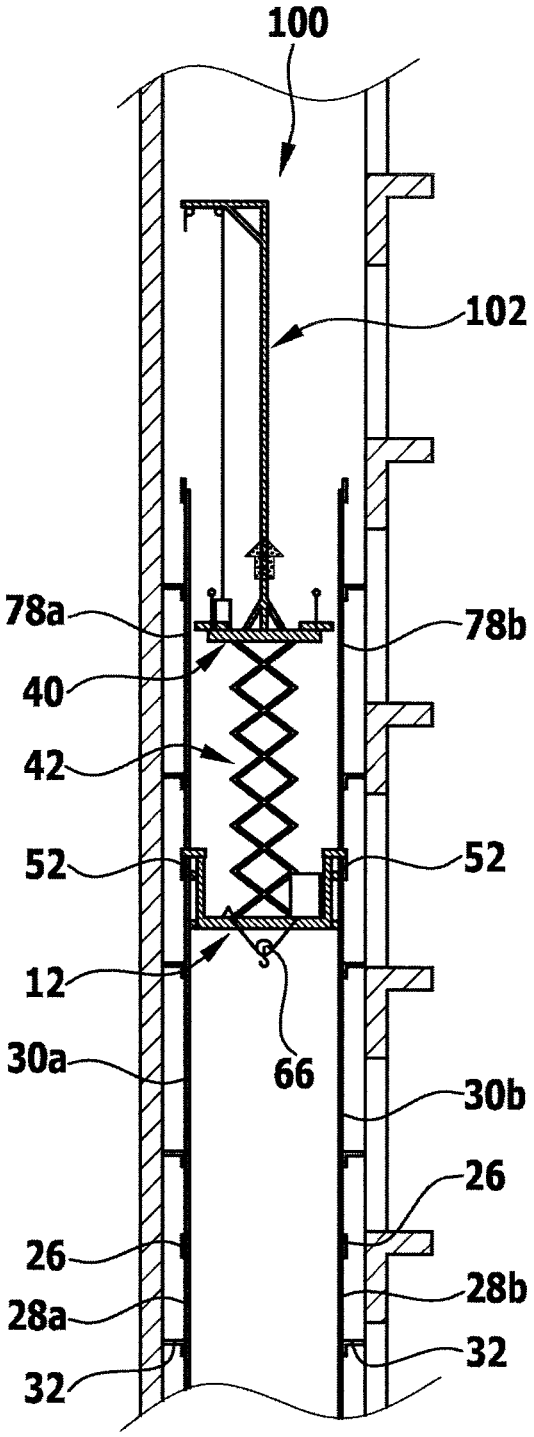
FIG. 8 is a schematic side profile view of the mounting system of FIG. 6, wherein the support platform is supported on the two connecting elements and the mounting platform is raised in order to mount third guide rails.
Figure 9:
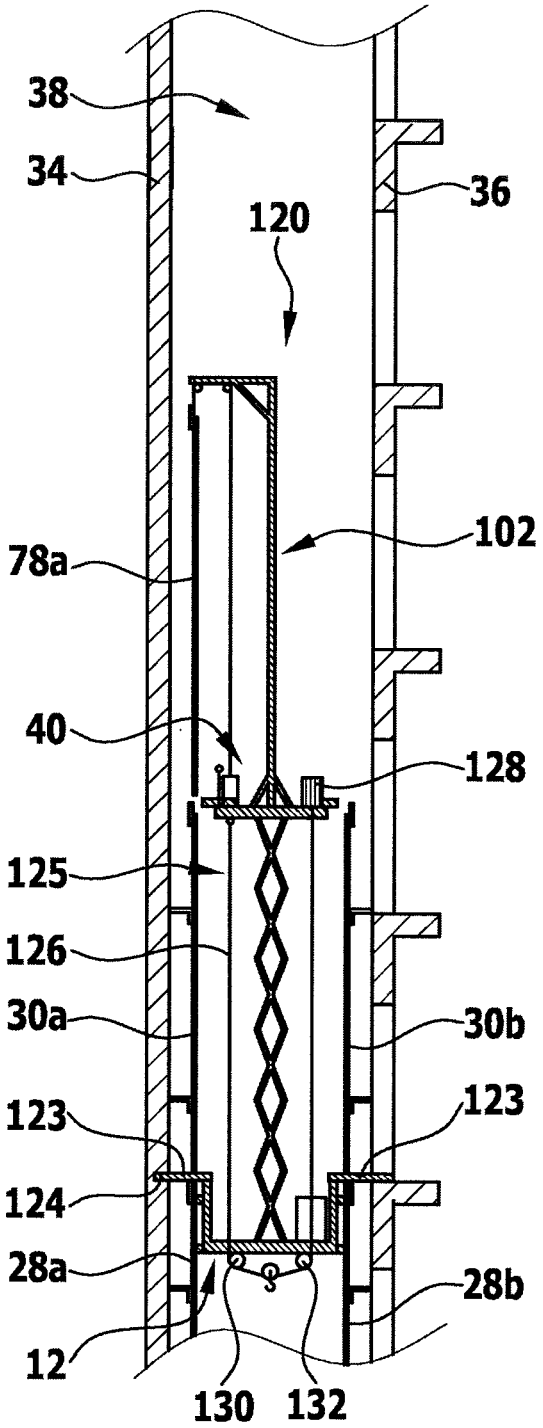
FIG. 9 is a schematic side profile view of an alternate embodiment of a mounting system of the present disclosure, wherein a support platform is supported on first connecting elements by means of which first guide rails are connected to second guide rails, and wherein a mounting platform assumes a position at the upper end of the second guide rails.

FIGS. 6, 7 and 8 schematically show a second embodiment of the mounting system according to the invention which is denoted by reference sign 100 overall and which, like a third embodiment of the mounting system according to the invention which is schematically shown in FIG. 9, is likewise largely identical to the mounting system 10 described above with reference to FIGS. 1 to 5. Therefore, the same reference symbols as used in FIGS. 1 to 5 are used in FIGS. 6, 7, 8 and 9 for identical components and, in order to avoid repetition, reference is made to the above explanations in respect of these components.

The mounting system 100 differs from the mounting system 10 only in that the mounting plate 44 of the mounting platform 40 has a lifting apparatus in the form of a lifting crane 102 which makes it easier to mount the guide rails in the shaft 38.

Both the support platform 12 and also the mounting platform 40 can be supported on the connecting elements 26, 52 by means of which two guide rails 28*a*, 30*a* and, respectively, 28*b*, 30*b* are connected to one another at the ends in the mounting system 100 too. The support platform 12 can be guided in the vertical direction on the guide rails 28*a*, 28*b*, 30*a*, 30*b* with the aid of guide elements, for example guide shoes 62, 64, while vertical guiding of the mounting platform 40 can be dispensed with since said mounting platform is held in a self-supporting manner on the support platform 12 with the aid of the scissors-type lifting table 42.

FIG. 9 shows a third embodiment of a mounting system according to the invention which is denoted by the reference symbol 120 overall. The mounting system 120 differs from the above-described mounting systems 10 and 100 in that the support platform 12 and also the mounting platform 40 are not supported on the guide rails but rather on the shaft wall. To this end, the support platform 12 and the mounting platform 40 of the mounting system 120 have movable extension arms 123 which can enter recesses 123 in the shaft walls 34, 36 in order to fix the support platform and, respectively, the mounting platform 40 in position. This allows the mounting system 120 to move independently of the guide rails. The support platform 12 and the mounting platform 40 of the mounting system 120 are supported directly on the shaft walls 34, 36. As an alternative or in addition, provision may be made for the extension arms 123 of the mounting system 120 to interact with supporting elements which are secured to the shaft walls 34, 36, in order to fix the support platform 12 and the mounting platform 20 in position. The supporting elements used may be, for example, steel supports.

The mounting system 120 which is illustrated in FIG. 9 further differs from the mounting systems 10 and 100 described above with reference to FIGS. 1 to 8 in that it has a lifting and pulling device which, in addition to the scissors-type lifting table 42, comprises a cable-pull system 125 having a traction cable 126 and a cable winch 128. The traction cable 126 is secured to the bottom face of the mounting platform 44 by way of a fixed end and guided around the deflection rollers 130, 132 which are mounted in a freely rotatable manner on the supporting plate 14, and can be wound up and unwound by means of the cable winch 128 which is arranged on the supporting plate 14. This allows the vertical distance between the support platform 12 and the mounting platform 40 to be reduced by means of the cable winch 128, so that the support platform can be raised by means of the cable winch 128 when the mounting platform 40 is fixed in position in the shaft 38 by means of the extension arms 123. In the mounting system 120, the scissors-type lifting table 42 serves to raise the mounting platform 40 when the support platform 12 is mounted fixed in position in the shaft 38.

The invention claimed is:

1. A method for mounting one or more components of an elevator system in a vertical shaft of a building by the use of a mounting system that is vertically moveable within the shaft and includes a lower support platform and an upper mounting platform that are arranged one above the other and have a lifting and pulling device coupled there between, wherein the support platform and the mounting platform are configured to be moved closer to or farther from each other by the lifting and pulling device and are configured to be alternatingly affixed in position in the shaft, the elevator system having at least one car configured to travel along one or more guide rails disposed within the shaft, the method comprising:

positioning the mounting system in the shaft of the building;

affixing the lower support platform to first support elements that are at least one of disposed in or secured to the walls of the shaft at a first vertical position, said affixing occurring by the engagement of support platform extension arms onto the first support elements;

raising the upper mounting platform vertically above the lower support platform by the lifting and pulling device;

mounting one or more components of the elevator system in the shaft from one of the lower support platform or raised upper mounting platform;

affixing the raised upper mounting platform to second support elements that are at least one of disposed in or secured to the walls of the shaft at a second vertical position located above the first vertical position, said affixing occurring by the engagement of mounting platform extension arms onto the second support elements;

unaffixing the support platform from the first position within the shaft by disengaging the support platform extension arms from the first support elements;

raising the support platform, by the lifting and pulling device, vertically upward toward the mounting platform; and affixing the lower support platform to the second support elements to which the upper mounting platform extension arms are simultaneously engaged, said affixing occurring by the engagement of the lower support platform extension arms onto the second support elements.

2. The method of claim 1, wherein said affixing steps comprise securing the respective support platform or mounting platform to the guide rails.

3. The method of claim 2, wherein the guide rails comprise a sequential chain of individual guide rails, coupled at their ends to the next guide rail in the sequence by one or more connecting elements, and wherein said securing the respective support platform or mounting platform to the guide rails comprises supporting the respective support platform or mounting platform on the connecting elements.

4. The method of claim 3, wherein, said step of affixing the lower support platform to first support elements disposed at a first vertical position further comprises supporting the support platform on a plurality of first connecting elements, said step of affixing the raised upper mounting platform to second support elements disposed at a second vertical position further comprises supporting the raised mounting platform on a plurality of second connecting elements disposed above the first connecting elements, and said step of affixing the lower support platform to the second support elements further comprises supporting the support platform on the same second connecting elements on which the upper mounting platform is simultaneously supported.

5. The method of claim 4, further comprising:

for each of said supporting steps, releasably connecting the extension arms of said respective support platform and mounting platform to each of a second coupling device secured to each connecting element on the guide rails.

6. The method of claim 4, wherein:

during said step of affixing the lower support platform to first support elements disposed at a first vertical position, coupling one of the plurality of first connecting elements between each of an upper end of one of the first guiderails and a lower end of one of the second guide rails, so as to join the first and second guiderails together;

during said step of raising the upper mounting platform, coupling one of the plurality of second connecting elements between each of an upper end of one of the second guiderails and a lower end of one of a plurality of third guide rails, so as to join the second and third guiderails together, said coupling being performed from said mounting platform;

during said step of affixing the raised upper mounting platform to second support elements disposed at a second vertical position, supporting said mounting platform on the second connecting elements.

7. A mounting system for mounting components of an elevator system in a shaft, comprising:

a plurality of support elements disposed vertically along a length of the shaft;

a lower support platform;

an upper mounting platform disposed above said lower support platform and configured to permit mounting of elevator components along a vertical length of the shaft; and a lifting and pulling device operatively coupled between said lower support platform and said upper mounting platform and configured to move said respective support and mounting platforms toward or away from each other, a plurality of mounting platform extension arms coupled to said upper mounting platform; and a plurality of support platform extension arms coupled to said lower support platform, wherein said extension arms of said mounting platform and said support platform are each configured to be selectively extended from said respective platform to an operative position or retracted toward said platform to an inoperative position, so as to respectively engage or disengaged from said support elements, wherein said support platform and said mounting platform are configured to be releasably affixed, in an alternating manner, at various vertical positions of the shaft by an engagement of said respective extension arms onto one or more of said support elements, wherein when one of said support platform or said mounting platform is affixed in said shaft, by the engagement of said affixed platform's respective extension arms onto support elements disposed at a first vertical position, the other of said support or said mounting platform may be moved relative to said affixed platform in a vertical direction along the length of the shaft, by said lifting and pulling device, and wherein said support platform and said mounting platform are configured to permit at least one extension arm from each of said support platform and said mounting platform to be simultaneously supported on the same support element that is disposed at a given vertical position.

8. The mounting system of claim 7, wherein said plurality of support elements are features defined in a shaft wall or structures secured to the shaft wall.

9. The mounting system of claim 7, further comprising a plurality of guide rails disposed along the shaft, wherein at least one of said extension arms of said support platform or said mounting platform are configured to be secured to the plurality of guide rails.

10. The mounting system of claim 9, further comprising:

a plurality of connecting elements, wherein a pair of said plurality of guiderails are configured to be coupled together at their respective ends by said connecting elements, and wherein at least one of said extension arms of said support platform or said mounting platform is configured to be supported on said connecting elements.

11. The mounting system of claim 10, further comprising:

a plurality of coupling devices, each secured to one of the plurality of connecting elements and configured to vertically support one or more of the support platform or mounting platform when said respective extension arms are in an extended activated position.

12. The mounting system of claim 11, wherein each of said support platform and said mounting platform comprise two extension arms.

13. The mounting system of claim 11, wherein said support platform comprises:

a supporting plate;

a pair of pillars coupled to said supporting plate and projecting vertically upward there from;

an extension arm operatively coupled to each one of said pillars;

at least two guide elements disposed on each of said pillars, said guide elements configured to be applied to said guide rails.

14. The mounting system of claim 7, wherein said mounting platform is held on said support platform in a self-supporting manner by said lifting and pulling device.

15. The mounting system of claim 7, wherein said lifting and pulling device is a scissors-type lifting table.

16. The mounting system of claim 11, wherein said lifting and pulling device includes a cable winch.

* * * * *